US006402142B1

(12) United States Patent
Warren et al.

(10) Patent No.: US 6,402,142 B1
(45) Date of Patent: Jun. 11, 2002

(54) METHOD FOR HANDLING OF CARDS IN A DEALER SHOE, AND A DEALER SHOE

(76) Inventors: David Warren, Rte. 32 and Quaker, Tilson, NY (US) 12486; Shane Long, 58 Depot Rd., Uncasville, CT (US) 06382

( * ) Notice: Subject to any disclaimer, the term of this patent is extended or adjusted under 35 U.S.C. 154(b) by 0 days.

(21) Appl. No.: 09/529,346

(22) PCT Filed: Oct. 13, 1998

(86) PCT No.: PCT/US98/21499

§ 371 (c)(1),
(2), (4) Date: Jun. 13, 2000

(87) PCT Pub. No.: WO99/19033

PCT Pub. Date: Apr. 22, 1999

Related U.S. Application Data

(60) Provisional application No. 60/061,995, filed on Oct. 14, 1997, and provisional application No. 60/081,165, filed on Apr. 8, 1998.

(51) Int. Cl.[7] ..... A63F 1/12

(52) U.S. Cl. ..... 273/149 R; 273/148 R; 273/148 A

(58) Field of Search ..... 273/148 R, 149 R, 273/150, 148 A, 292, 149 P

(56) References Cited

U.S. PATENT DOCUMENTS 3,929,339 A * 12/1975 Mattioli
4,377,285 A 3/1983 Kadlic
4,457,512 A * 7/1984 Stevenson
4,750,743 A * 6/1988 Nicoletti
5,374,061 A * 12/1994 Albrecht
5,382,024 A * 1/1995 Blaha
5,669,816 A * 9/1997 Garczynski
5,941,769 A * 8/1999 Order

FOREIGN PATENT DOCUMENTS

| | | |
|---|---|---|
| DE | 2443591 | 4/1975 |
| WO | WO 88/01892 | 3/1988 |
| WO | WO 96/14115 | 5/1996 |

* cited by examiner

*Primary Examiner*—Benjamin H. Layno
*Assistant Examiner*—V K. Mendiratta
(74) *Attorney, Agent, or Firm*—Dorsey & Whitney LLP

(57) ABSTRACT

An apparatus for dealing cards at a casino gaming table. The apparatus, or dealer shoe, has a base and a card roller. The base holds a deck or decks of cards while in use. The card roller is movably connected to the base and applies a downward pressure on the cards in the base so that they may be removed from the base. The card roller is moved into a resting place within the base when cards are removed to be shuffled, facilitating removal and insertion of the cards. By resting in the base, the card roller is protected from damage.

24 Claims, 8 Drawing Sheets

METHOD FOR HANDLING OF CARDS IN A DEALER SHOE, AND A DEALER SHOE

RELATED APPLICATION

This application claims priority from U.S. Provisional Application, Ser. No. 60/061,995, filed Oct. 14, 1997 and from U.S. Provisional Application Ser. No. 60/081,165 filed Apr. 8, 1998.

BACKGROUND

The field of the invention is the card dealing devices of the casino gaming industry. These card dealing devices tend to be unwieldy, awkward to use, highly likely to wear down and break, and inefficient.

What is needed is an easy to use card dealing apparatus.

What is needed is a long-lasting card dealing apparatus.

What is needed is an efficient card dealing apparatus.

What is needed is an easy to move card dealing apparatus.

What is needed is a durable card dealing apparatus.

What is needed is an easy to manufacture dealing apparatus.

What is needed is a better method for replacing cards in a dealing apparatus.

SUMMARY OF THE INVENTION

The invention is an apparatus for dealing cards at a casino gaming table. More particularly, it is a dealer shoe that provides convenient access to and removal of cards. Generally, it comprises a base, which has a resting place, and a card roller. The base holds one or more decks and applies a downward force on the cards during normal operation. Before the cards are replaced, the card roller is moved to the resting place within the base, facilitating removal and insertion of the cards. The card roller's connection to the base normally prevents the card roller from being removed from the base, so that it cannot be damaged.

It is an object of this invention to provide an easy to use card dealing apparatus.

It is an object of this invention to provide a long-lasting card dealing apparatus.

It is an object of this invention to provide an efficient card dealing apparatus.

It is an object of this invention to provide an easy to move card dealing apparatus.

It is an object of this invention to provide a durable card dealing apparatus.

It is an object of this invention to provide an easy to manufacture dealing apparatus.

It is an object of this invention to provide a better method for replacing cards in a dealing apparatus.

DETAILED DESCRIPTION

The invention relates to an apparatus for dealing cards. More particularly, it relates to a dealer shoe providing a dealer with convenient access to and removal of cards, that is not only easy to use, but is reliable, durable, and easy to manufacture. Generally, the novel dealer shoe is comprised of two parts: a base, which holds at least one deck of cards, and a card roller, which is movably connected to the base and which ensures proper movement of the cards in the base.

I. Preferred Embodiment

Figure 1A:
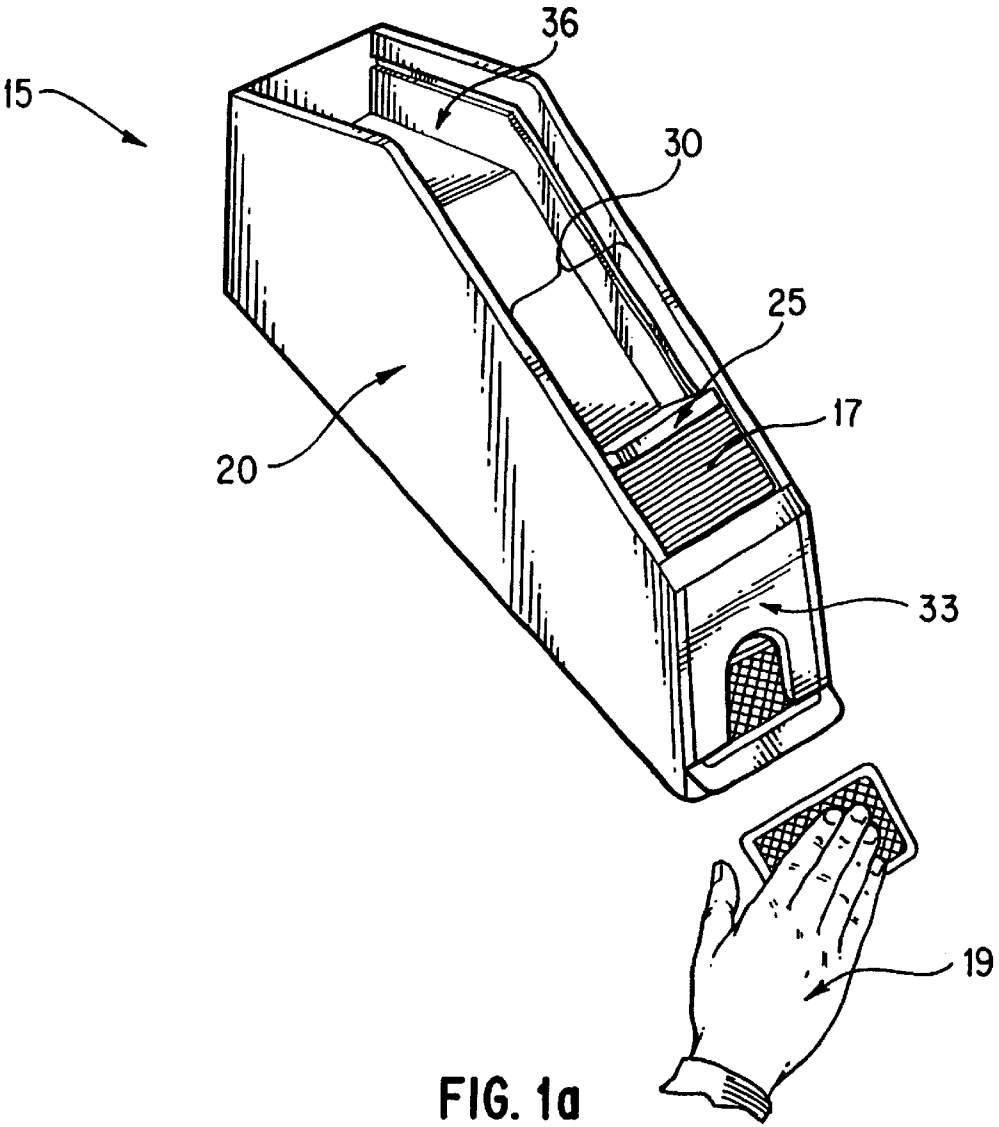
FIG. 1*a* is a perspective view of the dealer shoe in use.
Figure 1B:
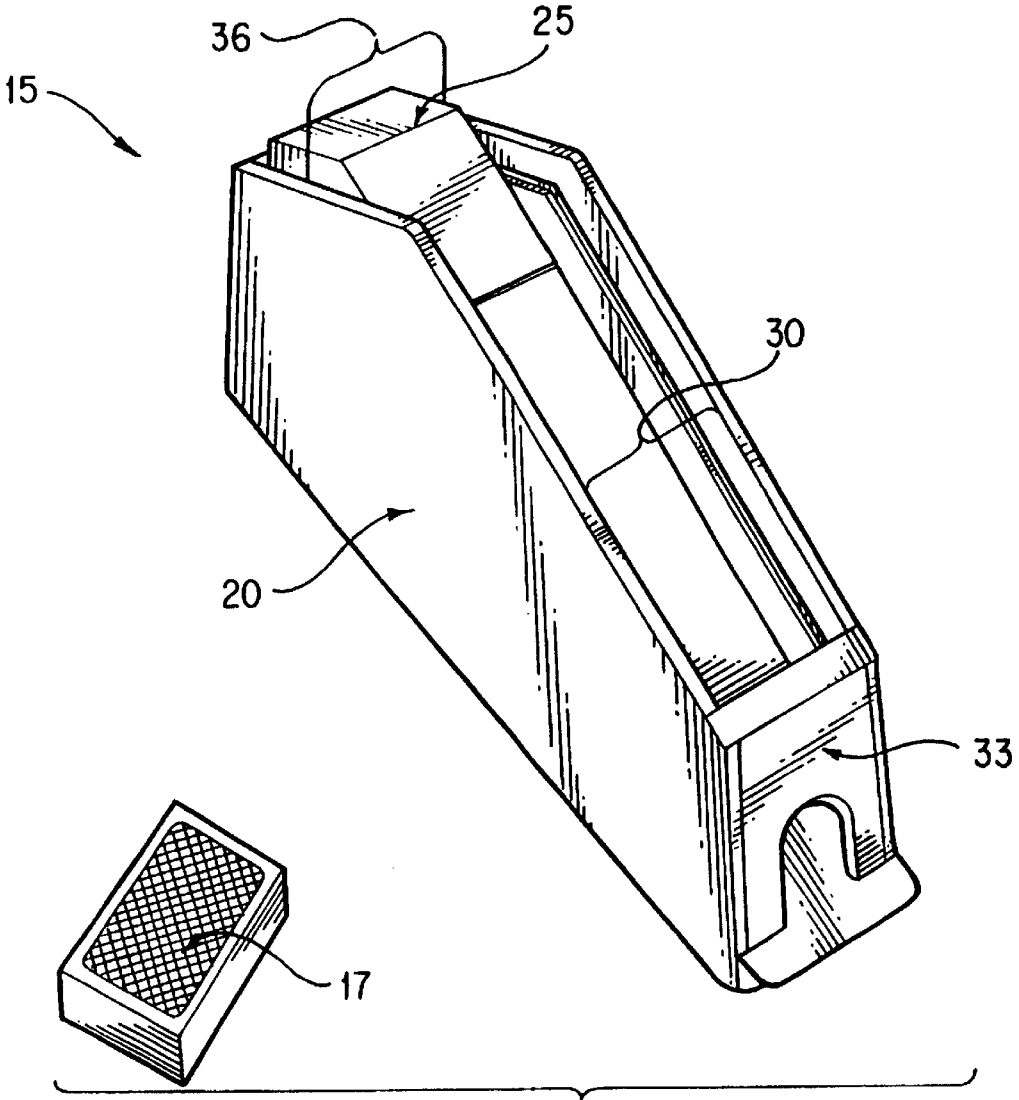
FIG. 1*b* is a perspective view of the dealer shoe with the card roller in the resting place.

FIGS. 1*a* and 1*b* show a preferred embodiment of the dealer shoe 15. FIG. 1*a* shows the preferred embodiment while in use and FIG. 1*b* shows the preferred embodiment while at rest. Both FIGS. 1*a* and 1*b* show two elements of the apparatus: a base 20 and a card roller 25. While in use, the card roller 25 is in the base 20, applying a downward force on the cards 17. As shown in FIG. 1*a*, there is a vacant resting place 36 in the base 20. When not in use, as shown in FIG. 1*b*, the card roller 25 is in the resting place 36, so that the cards 17 may be easily removed, replaced, and/or shuffled.

The base 20 generally sits on a table (not shown), such as a gaming table, and has a card channel 30, a card door 33, and a resting place 36. As shown in FIG. 1*a*, while in use the card channel 30 holds playing cards 17 and the card roller 25. The card door 33 keeps the cards 17 in the card channel 30 and allows the dealer 19 to remove one card 17 at a time. The resting place 36 allows the card roller 25 to rest within the base 20 so that it does not interfere with the replacement of the cards 17. Generally, the playing cards 17 are standard playing cards used in a casino.

Referring to FIGS. 1*a* and 1*b*, in the preferred embodiment, the card roller 25 is movably connected to the base 20 and while in use is positioned within the card channel 30 of the base 20. While in use, the card roller 25 applies a downward force on the cards 17 in the card channel 30. The downward force causes the cards 17 to move downward, sliding down the ramp, so that each time an individual card 17 is removed through the card door 33, another card 17 moves into position against the card door 33. While at rest, the card roller 25 is positioned within the resting place 36, as shown by FIG. 1*b*. The form of the resting place 36 keeps the card roller 25 at rest until the dealer 19 (not shown) moves the card roller 25 out of the resting place 36 and into use.

Once again referring to FIGS. 1*a* and 1*b*, generally, the card roller 25 and the base 20 will be made out of the same material so as to simplify manufacturing and to reduce time and cost of manufacturing. Although plastic is preferred, both the base 20 and the card roller 25 can be made from a variety of materials including any type of metal, plastic, wood, rubber, plexiglass, or a combination thereof.

Figure 7A:
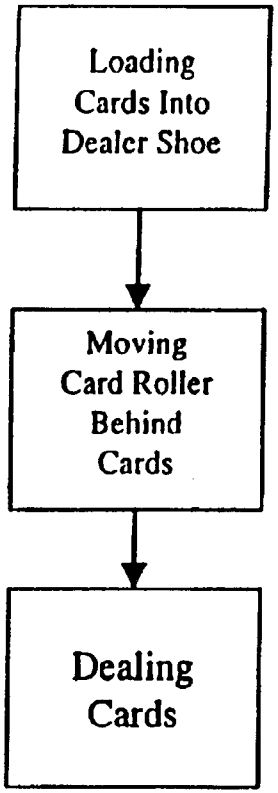
FIGS. 7*a* & 7*b* are flowcharts of a preferred method of the present invention.
Figure 7B:
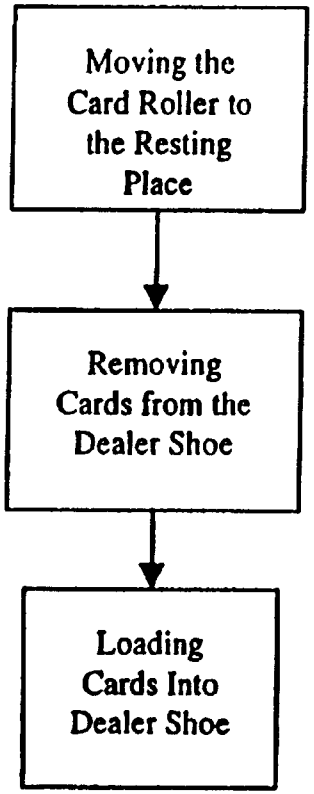

FIGS. 1*a*, 1*b*, 7*a*, and 7*b* best illustrate the novel method of using the dealer shoe. The method for providing convenient access to and removal of cards 17 starts with the step of inserting or loading one or more decks of cards 17 in the base 20 of the dealer shoe 15, and moving the card roller 25 behind the cards 17, as seen in FIG. 7*a*. After dealing cards 17, the next step is replacing the remaining cards 17 in the base 20. This involves the steps of moving the card roller 25 to a resting place 36 in the base 20 that will not interfere with the replacement of the cards 17, and removing and reshuffling or replacing the remaining cards 17, as shown in FIG. 7*b*.

Figure 2:
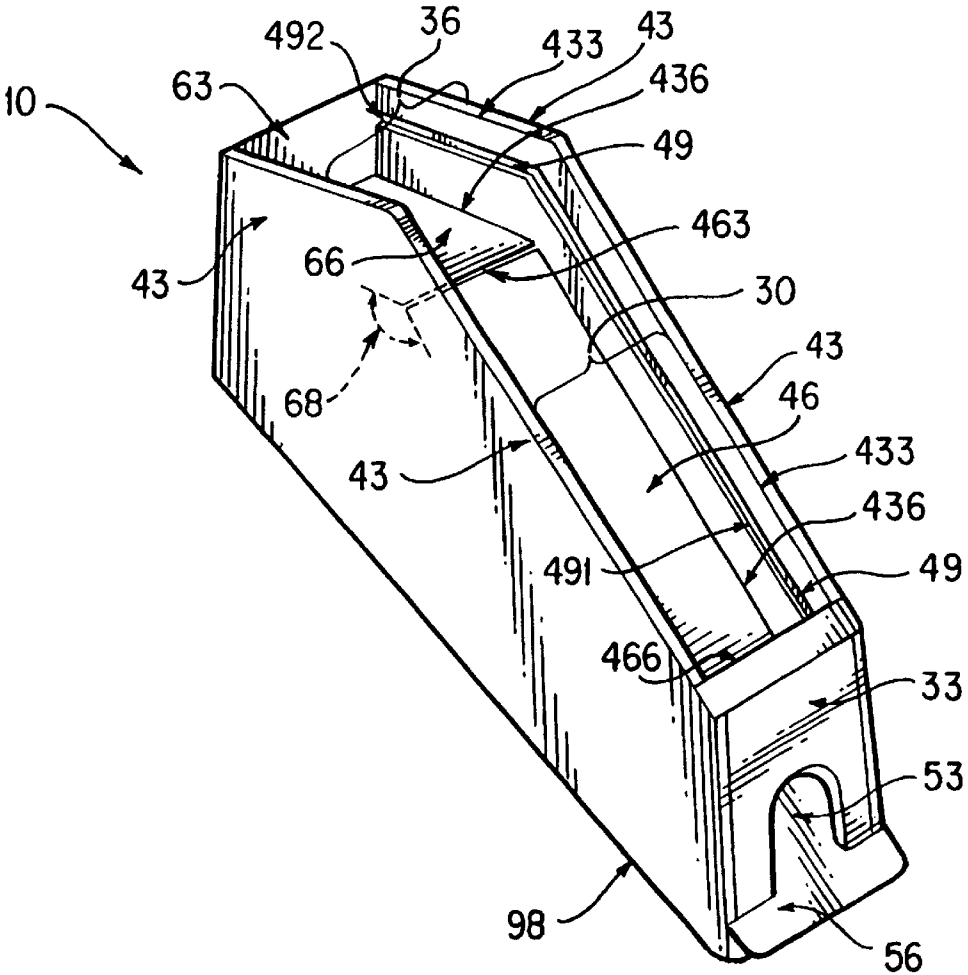
FIG. 2 is a perspective view of the base without the card roller.

FIG. 2 shows a preferred embodiment of the base 20. FIG. 2 shows the base 20 with a bottom 98, the card channel 30, the card door 33, and the resting place 36. The bottom of the base 98 normally rests on whatever surface the dealer shoe 15 is being used on (such as a casino table), and is normally flat. The card channel 30 has a ramp 46, two opposing walls 43, and two glide tracks 49. The ramp 46 has a top 463 and bottom 466 and it slopes downward from the top 463 to the bottom 466, as shown in FIG. 2. The cards 17 (not shown in this figure) and the card roller 25 (not shown in this figure) are situated on the ramp 46 when the dealer shoe 15 is in use. The angle between the ramp 46 and the base bottom 98 is called the ramp angle 47(not shown). The ramp angle 47 may range from as much as 5° to 85°, but it is preferably in the range of 10° to 30°.

The opposing walls 43 of the card channel each have an upper edge 433 and lower edge 436. Both of the glide tracks 49 run the entire length of the card channel 30, following the slope of the ramp 46. The glide tracks 49 are located between the upper edges 433 and lower edges 436 of the opposing walls 43, with one glide track 49 on each wall 43. The glide tracks 49 allow the card roller 25 to be movably connected to the base 20. Each of the glide tracks 49 are generally in the shape of two parallel rails having an opening 491 in the center through which the card roller 25 is connected. The glide tracks 49 also each have an open end 492 which is normally covered. When these open ends 492 are exposed, the card roller 25 can be removed from the base.

Referring to FIG. 2, the card door 33 is shown to have a finger access 53 and a card slot 56. The finger access 53 allows a dealer 19 (not shown) to put a finger on the card 17 (not shown) at the bottom of the ramp 466. The card slot 56 allows the dealer 19 (not shown) to slide this card 17 through the card door 33, removing the card 17 (not shown) from the dealer shoe 15.

Again referring to FIG. 2, the resting place 36 is shown to include two opposing walls 43, a rear wall 63, a resting surface 66, and a glide track 49. The two opposing walls 43 each have an upper edge 433 and lower edge 436, and are extensions of the opposing walls 43 of the card channel 30. The rear wall 63 prevents the card roller 25 from falling out of the dealer shoe 15 when it is in the resting place 36. The rear wall 63 may be attached to the base by screws, hooks, or other fastening means. The rear wall 63 is removed in order to remove the card roller 25. Removing the rear wall 63 exposes the glide track open ends 492, so that the card roller 25 may be slid out of or inserted into the base 20.

As shown in FIG. 2, the resting surface 66 is connected to the top of the ramp 463, and is shown sloping downward in the opposite direction of the ramp 46. This sloping direction causes the card roller 25 to rest against the rear wall 63 when it is in the resting place 36. The angle formed between the resting surface 66 and the ramp 46, called the peak angle 68, is generally obtuse. The glide tracks 49 shown in the resting place are extensions of the glide tracks 49 in the card channel 30, and also allow the card roller 25 to movably connect to the base 20. These glide tracks are also located between the upper edges 433 and lower edges 436 of the opposing walls 43, and generally, are parallel to and follow the same slope of the resting surface 66.

Figure 3B:
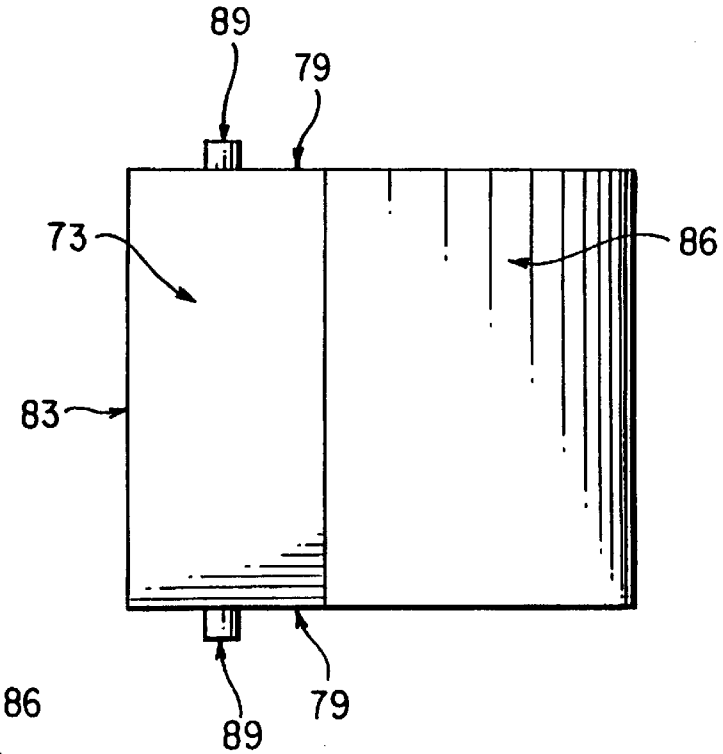
FIG. 3*b* is a top view of the card roller.
Figure 3C:
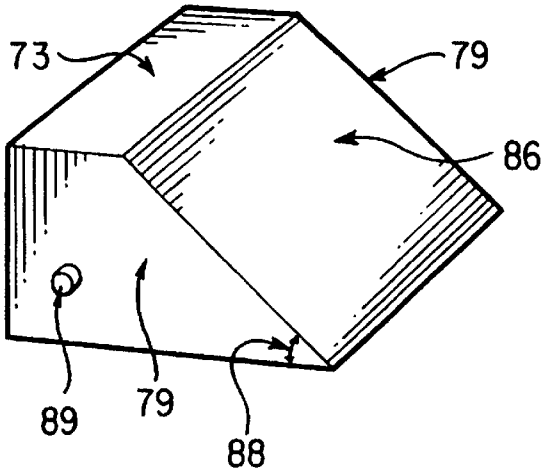
FIG. 3*c* is a perspective view of the card roller.
Figure 3A:
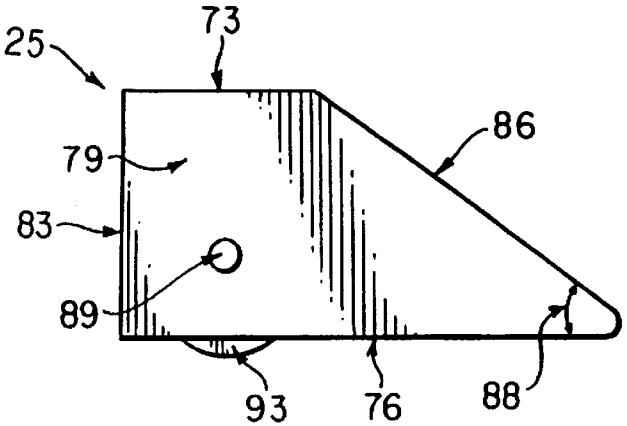
FIG. 3*a* is side view of the card roller.

FIGS. 3*a*, 3*b*, and 3*c* show a preferred embodiment of the card roller 25. In a preferred embodiment, the card roller 25 is of sufficient size and weight to apply a force on the cards 17 (not shown in this figure). The force on the cards must be enough to cause the cards 17 to slide down the ramp 46 (not shown in this figure) so that when an individual card 17 is removed from the card door 33, another card 17 slides into position to be removed.

FIGS. 3*a*, 3*b*, and 3*c* show that the card roller 25 has a top 73, a bottom 76, two sides 79, a rear 83, a front 86, at least two track guides 89, and at least one wheel 93. The top 73 is the surface of the card roller 25 that faces up when the card roller 25 is at rest or in use. The dealer 19 (not shown) moves the card roller 25 to the resting place 36 by gripping the top 73 and the sides 79 and rolling the card roller 25 up the ramp 46 and over the peak angle to the resting place 36. The card roller bottom 76 is the surface opposite to the top 73, which is in contact with the ramp 46 or the resting surface 66. Each of the two sides 79 faces one of the opposing sides 43. The card roller rear 83 faces the rear wall 63 and is in contact with the rear wall 63 when the card roller 25 is in the resting place 36.

Referring to FIGS. 3*a*, 3*b*, and 3*c*, the card roller front 86 is the surface opposite the rear 83. When in use, the front 86 is flush with the back of the card 17 that is closest to the top of the ramp 463. The front 86 is sloped so that it is approximately parallel to the card door 33 when the dealer shoe 15 is in use and the card roller 25 is in the card channel 30. Preferably, this front slope angle 88 is approximately the same as the angle between the card door 33 and the ramp 46. This helps position the cards 17 so only one card 17 may exit through the card slot 56 at a time.

The front slope angle 88 is preferably greater than the ramp angle 47 formed between the ramp 46 and the bottom of the base 98. In the preferred embodiment, the sum of peak angle 68 and the front slope angle 88 approximately equals 180°. Therefore, when the card roller 25 is in the resting place 36, this angle sum causes the card roller front 86 to be flush with the ramp 46, and the two form one continuous, smooth surface. This makes the removal and replacement of the cards 17 (not shown) easier. In one example, the peak angle 68 is 140° and the front slope angle 88 is 40°. In this example, the ramp angle 47 would be approximately 30° and the angle between the card door 33 and the ramp 30 would be approximately 40°. Preferably, the ramp angle 47 is between 5° and 60°, the front slope angle 88 is between 5° and 90°, and the peak angle 68 is between 90° and 175°.

Referring again to FIGS. 3*a*, 3*b*, and 3*c*, the track guides 89 are located with one track guide on each card roller side 79. The track guides 89 help to movably connect the card roller 25 with the base 20 by being positioned within the glide tracks 49. The track guides 89 are preferably smooth and cylindrically shaped, and are of sufficient length and size to stay positioned within the glide tracks 49 under normal conditions. The track guides 89 fit through the open sides 491 of the glide tracks 49. The track guides 89 are positioned within the glide tracks 49 by removing the rear wall 63 and then sliding the guides 89 into the open ends 492 of the glide tracks 49. Connected as such, the card roller 25 is guided up and down the glide tracks 49. This connection helps the card roller 25 to move and operate smoothly. Normally, this connection also keeps the card roller 25 from being removed from the base 20. This connection prevents or reduces the damage and wear a card roller 25 might normally experience when removed from the base 20. For example, when a card roller 25 is removed from the dealer shoe, it is often dropped, chipped, cracked, scratched, or otherwise damaged.

Once more referring to FIGS. 3*a*, 3*b*, and 3*c*, a wheel 93 extends from the bottom 76. The wheel 93 has an axle (not shown) that keeps it at the proper height, so that the card roller 25 operates correctly. The axle also connects the wheel to the card roller 25. One of ordinary skill in the art should be able to construct the axle to connect the wheel 93 to the card roller 25. The wheel 93 is in contact with the ramp 46 or the resting surface 66, depending on where the card roller 25 is located. The wheel 93 helps the card roller 25 to move smoothly and easily. The wheel 93 allows the dealer 19 to move the card roller 25 to the resting place 36 without much effort. The wheel 93 also reduces the effect of friction on the card roller 25, thereby allowing the card roller 25 to more efficiently force the cards 17 downward. The height of the wheel 93 is preferably less than the height of a card. The wheel 93 is wide enough so that the card roller 25 stays balanced. The wheel may be made from a variety of materials, including: any type of metal, plastic, wood, rubber, plexiglass, or a combination thereof.

The construction of the dealer shoe 15 can be accomplished in a variety of ways. One such manner of manufacturing would be to build molds for the base 20 and card roller 25 and then pour whatever material was being used into the molds. After the material solidified, the base 20 and card roller 25 would be removed from the molds, and whatever finishing touches were necessary could be completed. Likewise, the base 20 and card roller 25 could be machined or sculpted from the material to be used. Furthermore, the base 20 and card roller 25 could be divided into portions, which would be individually manufactured and then combined to produce the dealer shoe 15.

II. Alternative Embodiments

Figure 4:
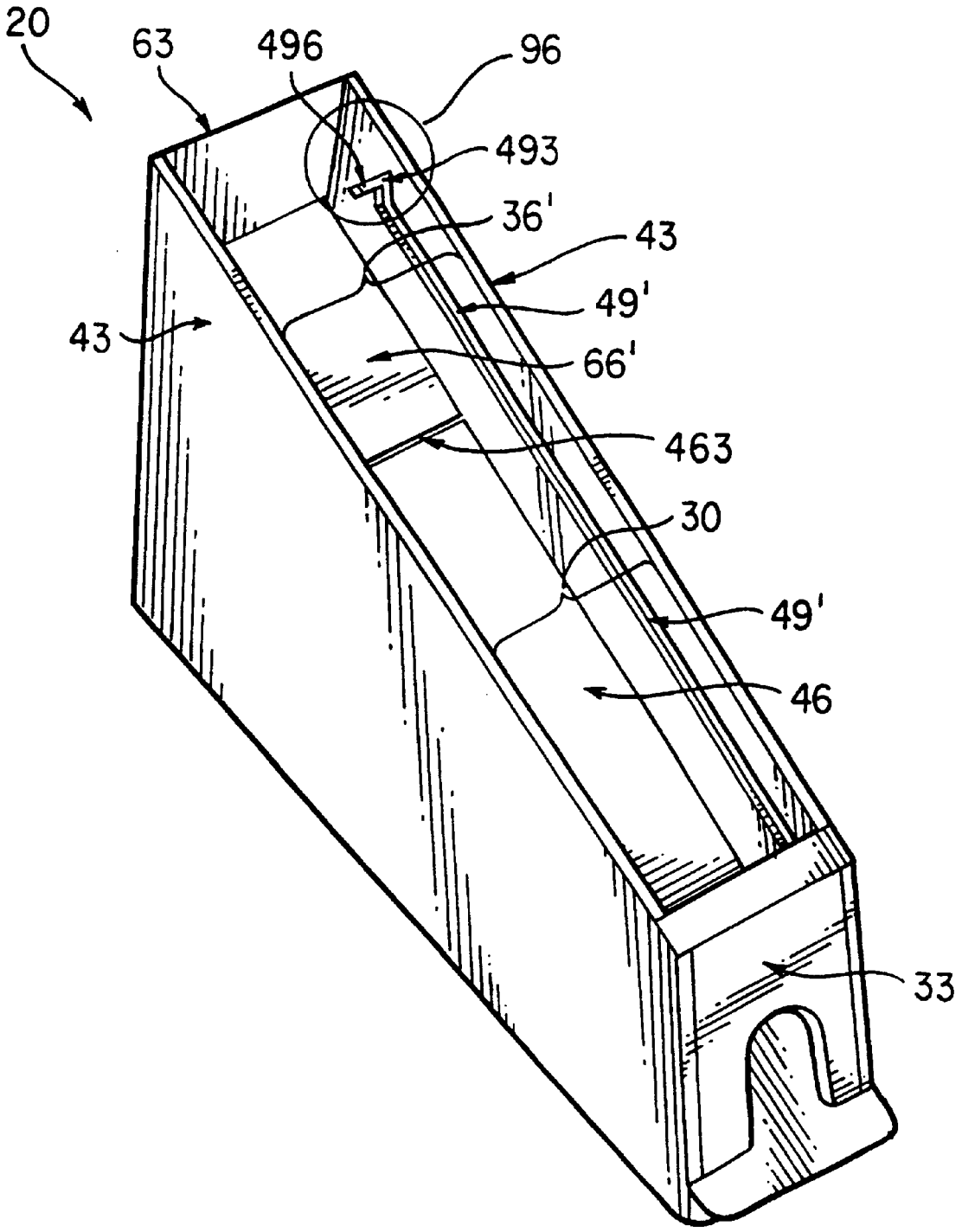
FIG. 4 is a perspective view of an alternative embodiment of the dealer shoe.

FIG. 4 shows an alternative embodiment of the base 20, wherein the card roller 25 is held in the resting place 36' by a different mechanism. The base 20 has a card channel 30, a card door 33, and a resting place 36'. The resting place 36' shown in FIG. 4 is different than the resting place 36 shown in FIGS. 1*a*, 1*b*, and 2. The resting place 36' has two opposing walls 43. a rear wall 63, a resting surface 66', and a glide track 49', as above. The differences are seen in the resting surface 66' and the glide track 49', as described below.

Referring to FIG. 4, the resting surface 66' is connected to the top of the ramp 463. The resting surface 66', however, slopes downward at approximately the same angle and in the same direction as the ramp 46. The glide track 49' is an extension of the glide track 49' in the card channel 30, but, it has a lock 96 at its end. This lock 96 holds the card roller 25 in the resting place 36'. The lock 96 is preferably formed by the glide track 49' having a moderate upward slope 493 followed by a sharp downward drop 496, as shown by FIG. 4. Having an upward slope 493 allows for a greater downward drop 496, and therefore, a more effective lock 96. The card roller 25 can be moved out of the resting place 36' simply by lifting it high enough for the track guides 89 to clear the sharp downward drop 496.

Figure 5:
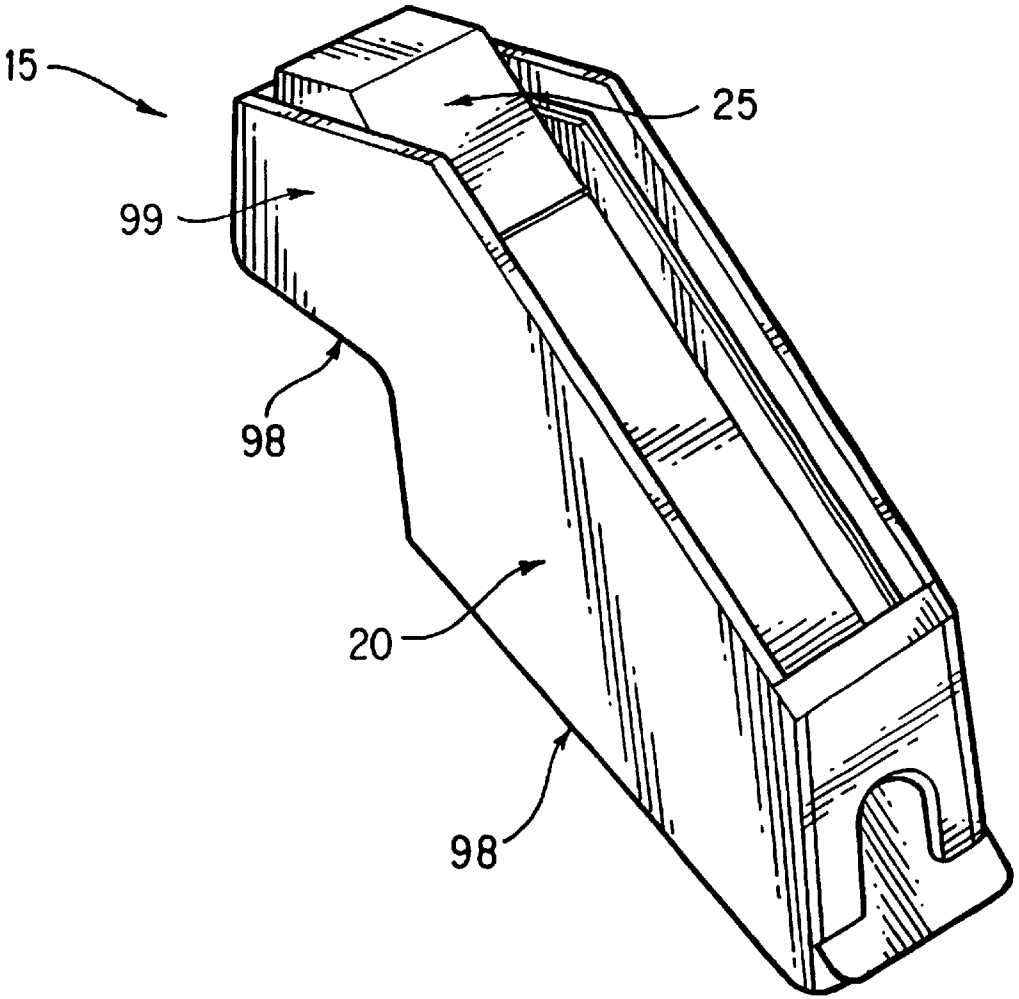
FIG. 5 is a perspective view of another embodiment of the dealer shoe.

FIG. 5 shows another alternative embodiment of the base 20, in which the base bottom 98 is different. In FIG. 5, the base 20 has been formed so that the base bottom 98 is not flat. Therefore, at one end of the base 20, the base bottom 98 does not rest upon the table or other supporting surface. Rather, the base 20 has been formed to have a handle 99 at this end. This handle 99 allows for the dealer shoe 15 to be more easily handled and moved around. Forming the base 20 with this handle 99 also reduces the amount of material needed for the base 20, and thereby reduces the weight of the base 20.

Figure 6:
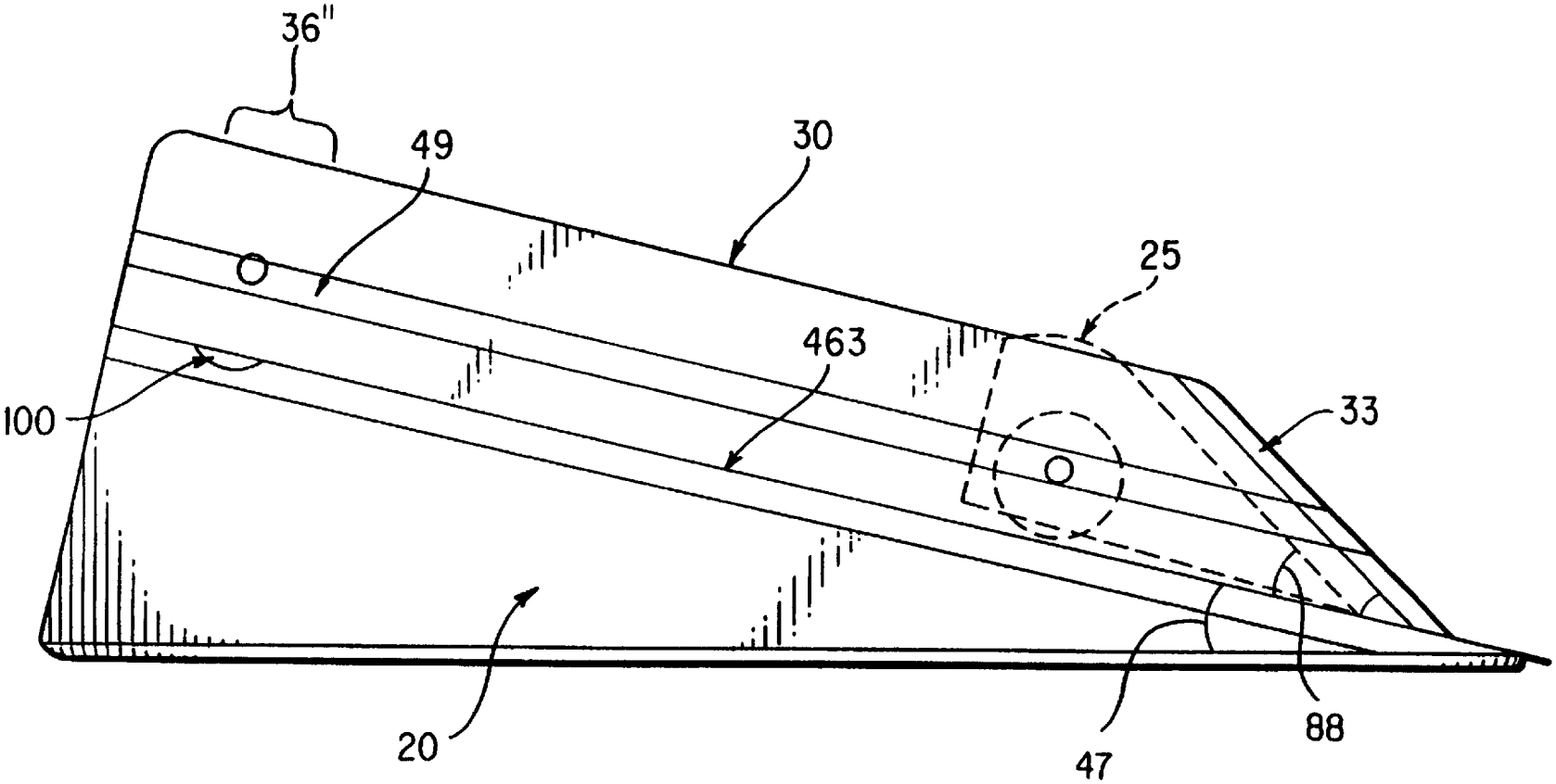
FIG. 6 is a side view of another embodiment of the dealer shoe.

FIG. 6 shows an alternative embodiment of the base 20, wherein the card roller 25 is held in the resting place 36" by a different mechanism. This embodiment of the base 20 also has a card channel 30, a card door 33, and a resting place 36". The resting place 36" shown in FIG. 4 is different than the resting places 36 and 36' shown in FIGS. 1*a*, 1*b*, 2, and 4. The resting place 36" has two opposing walls 43, a rear wall 63, a resting surface 66", and a glide track 49, as above. The differences are seen in the resting surface 66".

Referring to FIG. 6, the resting surface 66" is connected to and continuous with the ramp 463. Indeed, the resting surface 66" is similar to and has the same slope as the ramp 463. In this embodiment, the ramp angle 47 is 12.5°, the front slope angle 88 is 30°, and the angle between the card door 33 and the ramp is 30°. The resting surface 66", however, also has a wheel holder 100. When the card roller 25 is in the resting place 36", the wheel 93 rests in the wheel holder 100. The wheel holder 100 is a depression of sufficient depth to hold the card roller 25 still when the wheel 93 rests in the wheel holder 100. To put the card roller 25 back in use, the dealer simply moves the card roller 25 so that the wheel 93 rolls out of the wheel holder 100.

There are many other possible variations to the novel dealer shoe. For example, the card roller 25 could be a variety of shapes, including a cylinder. In an alternative embodiment, the card roller 25 includes finger holes in its top 73 or a handle to make the handling of the card roller 25 easier. Furthermore, in additional embodiments, the glide tracks 49, and thereby the track guides 89, have a different form. For example, in one such alternative embodiment the glide tracks 49 could have ball bearings in them to provide for a smoother glide, or the glide tracks 49 could have a hinged hatch to allow the opening of the track and removal of the track guides 89, and hence, the card roller 25. In another embodiment, the track guides 89 are spring-loaded, so that the track guides 89 can squeezed to be removed from the glide tracks 49.

In still another embodiment, the wheel 93 is replaced by multiple wheels or removed altogether. Likewise, in other embodiments, the resting place 36 takes different forms, such as a latch for a spring-loaded card roller discussed below.

Another embodiment of the dealer shoe includes a spring-loaded card roller. The spring causes the card roller to apply the necessary force on the cards, instead of or in addition to the downward force normally created by the card roller. The base in this embodiment may have a horizontal ramp or a sloped ramp. A latch or lock in the resting place allows the card roller to be locked into a resting place so that the cards are easily removed.

The terms and descriptions used here are set forth by way of illustration only and are not meant as limitations. Those skilled in the art will recognize that numerous variations are possible within the spirit and scope of the invention as defined in the following claims.

What is claimed is:

1. A method for providing access to and removal of cards in a dealer shoe, comprising the steps of:

placing one or more decks of cards in a dealer shoe comprised of a base and a card roller connected to the base; and replacing or shuffling the cards in the dealer shoe, comprising the steps of:

removing the cards from the dealer shoe;

inserting cards into the dealer shoe; and moving the card roller to a resting place in the base, whereby the roller will not interfere with the replacing step.

2. The method of claim 1 further comprising:

moving the card roller away from the resting place in the base, wherein the card roller remains connected to the base during movement.

3. The method of claim 1 or 2, wherein the card roller has one or more track guides and is connected to the base with the one or more track guides and one or more glide tracks, and wherein the step of moving the roller to a resting place comprises:

sliding the card roller along the glide tracks.

4. The method of claim 2, wherein the base comprises a ramp and the inserted cards are inserted on the ramp, and wherein the step of moving the card roller away from the resting place comprises:

positioning the card roller on the ramp whereby some of the weight of the card roller rests upon the inserted cards.

5. The method of claim 2 or 4, wherein the card roller further comprises a wheel and the step of moving the card roller away from the resting place includes rolling the card roller over an angled peak.

6. The method of claim 1, 2, or 4, wherein the removed cards are shuffled and then the shuffled cards are inserted into the shoe by the inserting step.

7. A dealer shoe for providing access to and removal of cards, comprising:

a base, that holds one or more decks of cards while in use, comprising a resting place;

a card roller, movably connected to the base and situated within the base, wherein the card roller normally supplies a force against the cards in the base; and wherein the card roller rests in the resting place during replacement of the one or more decks of cards so that the card roller does not interfere with the replacement of the one or more decks of cards.

8. The dealer shoe of claim 7 wherein the card roller is non-removably movably connected to the base.

9. The dealer shoe of claim 7 or 8, wherein the base further comprises a glide track by which the card roller is movably connected to the base.

10. The dealer shoe of claim 7 or 8, wherein the resting place comprises a resting surface that is sloped so that the force of gravity holds the card roller in place in the resting place.

11. The dealer shoe of claim 7 or 8, wherein the resting place comprises a glide track and the glide track has a lock on it that holds the card roller within the resting place.

12. The dealer shoe of claim 7 or 8, wherein the base further comprises a card channel, wherein the one or more decks of cards are placed.

13. The dealer shoe of claim 12, further comprising glide track in the card channel and resting place.

14. The dealer shoe of claim 7 or 8, wherein the base further comprises:

a card door which holds the cards within the card channel and allows access and removal of one card at a time.

15. The dealer shoe of claim 7 or 8, wherein the base comprises a ramp formed within the card channel and wherein the resting place and the ramp meet at an obtuse peak angle.

16. The dealer shoe of claim 15 whereby the card roller and the ramp are generally flush, flat or level when the card roller is in the resting position.

17. The dealer shoe of claim 7 or 8, wherein the card roller has a bottom and front and wherein the card roller front rests up against a card.

18. The dealer shoe of claim 17 whereby the obtuse peak angle plus an angle formed by the bottom and front of the card roller form an angle of approximately 180 degrees.

19. The dealer shoe of claim 7 or 8, wherein the card roller further comprises a wheel which rotates when the card roller is moved.

20. A dealer shoe for providing access to and removal of cards, comprising:

a base, comprising:

a card channel, with a ramp, two opposing walls, and two glide tracks, wherein the one or more decks of cards are placed while in use;

a card door, with a finger access and a card slot, whereby a dealer removes one card at a time by placing a finger onto a card, through the finger access, and by sliding that card through the card slot and out of the dealer shoe; and a resting place, with a rear wall, two opposing walls, two glide tracks, and a resting surface; and a card roller, movably connected to the base and situated within the card channel while in use and the resting place while at rest, for applying a force upon the one or more decks of cards in the base, whereby the cards can be removed from the dealer shoe using the card door one card at a time, comprising:

a top, which faces up and out of the base, whereby the dealer can move the card roller by gripping the top;

a bottom, which is opposite of the top, and which faces the ramp or resting surface of the base;

two sides, which face the two opposing walls of the base;

a rear, which faces the rear wall of the base, and which rests against the rear wall when the card roller is in the resting place;

a front, which is opposite of the rear, that pushes flush against the cards in the base and which is sloped so that it is approximately parallel to the card door when it is in the card channel so that it properly positions the cards to be removed one at a time through the card door;

a wheel, which extends out of the bottom of the card roller, that reduces the friction on the card roller, is in contact with the ramp or the resting surface of the base and that rotates when the card roller is moved; and two track guides, with one guide on each of the two sides, that movably connect the card roller to the base by being positioned within the glide tracks and that help provide for the easy and smooth movement of the card roller; and whereby the card roller can be placed in the resting place when at rest or not in use and the cards in the card channel may be removed, shuffled and re-inserted or replaced with other cards without interference from the card roller.

21. The dealer shoe of claim 7, 8, or 20, wherein the resting place comprises:

a wheel holder that holds the wheel of the card roller so that the card roller remains in the resting place.

22. A method for providing access to and removal of cards in a dealer shoe, comprising the steps of:

placing a first set of cards in a dealer shoe, wherein the dealer shoe includes a base and a card roller connected to the base;

removing a subset of the first set of cards from the dealer shoe, whereby the cards remaining in the dealer shoe after the removing step are a remaining set of cards;

moving the card roller to a resting place in the base;

replacing the remaining set of cards in the dealer shoe, the replacing step comprising the steps of:

removing the remaining set of cards from the dealer shoe; and inserting a second set of cards into the dealer shoe; and whereby the card roller in the resting place does not interfere with the replacing step.

23. The method of claim 22, wherein the replacing step further comprises the step of:

shuffling the first set of cards, the second set of cards being the shuffled first set of cards.

24. A dealer shoe that provides access to and removal of cards, comprising:

a base, that holds a set of cards while in use, comprising a resting place;

a card roller, movably connected to the base and situated within the base, wherein the card roller normally supplies a force against the set of cards in the base; and wherein the card roller rests in the resting place during replacement of the set of cards so that the card roller does not interfere with the replacement of the set of cards.

* * * * *